313-414 SR
6/7/77 OR 4,028,581

United States Patent [19]

Stratton

[11] 4,028,581

[45] June 7, 1977

[54] PLURAL BEAM ELECTRON GUN ASSEMBLY

[75] Inventor: Michael G. Stratton, Seneca Falls, N.Y.

[73] Assignee: GTE Sylvania Incorporated, Stamford, Conn.

[22] Filed: June 24, 1976

[21] Appl. No.: 699,441

[52] U.S. Cl. ..... 313/414; 313/409

[51] Int. Cl.[2] ..... H01J 29/50; H01J 29/51

[58] Field of Search ..... 313/409, 411–415, 313/417

[56] References Cited

UNITED STATES PATENTS

| | | | |
|---|---|---|---|
| 3,294,999 | 12/1966 | Van Hekken | 313/414 |
| 3,619,686 | 11/1971 | Miyaoka | 313/412 |
| 3,755,703 | 8/1973 | Ueno et al. | 313/409 |
| 3,883,771 | 5/1975 | Ohgoshi et al. | 313/412 |
| 3,906,279 | 9/1975 | Linssen | 313/412 X |

*Primary Examiner*—Robert Segal
*Attorney, Agent, or Firm*—Norman J. O'Malley; Frederick H. Rinn; Robert T. Orner

[57] ABSTRACT

A cathode ray tube plural-beam-in-line bi-potential electron gun assembly, having applied beam currents of differing levels, manifests structurally modified gun structures to effect focused beam landings at the screen that are evidenced as substantially equi-sized spots thereby providing improved resolution and brightness of the screen imagery. The structural changes embody modifications of the related focusing and accelerator electrodes of the respective guns to provide a partial telescoping arrangement for effecting the discrete placement, forming and shielding of the final focusing lenses. The three lenses so formed are in different planes in partial overlapping axial relationship.

9 Claims, 6 Drawing Figures

Fig. 1
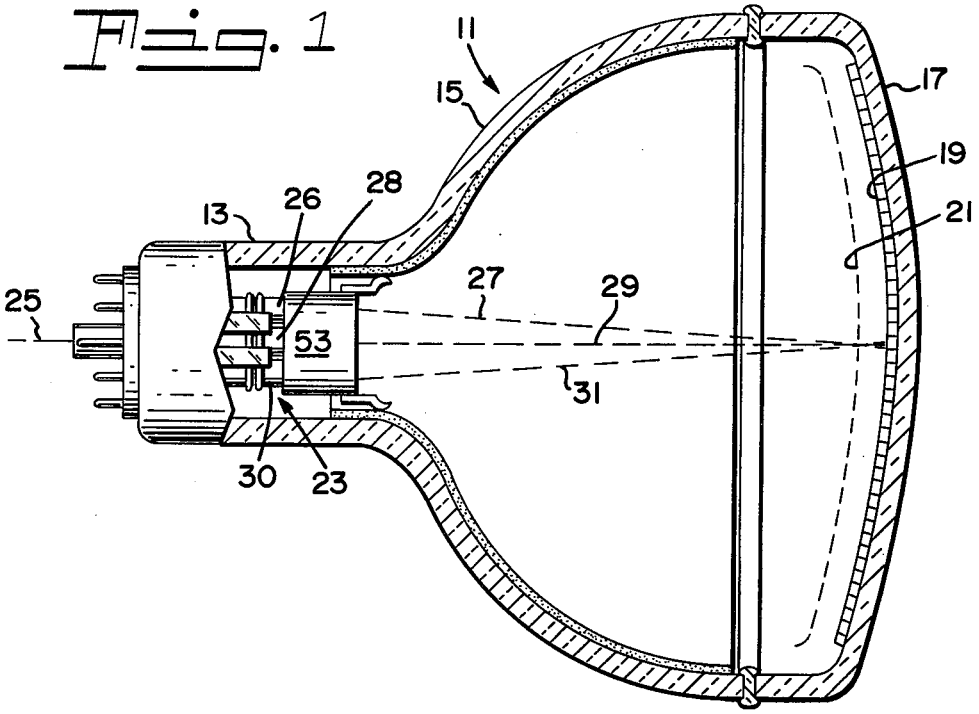
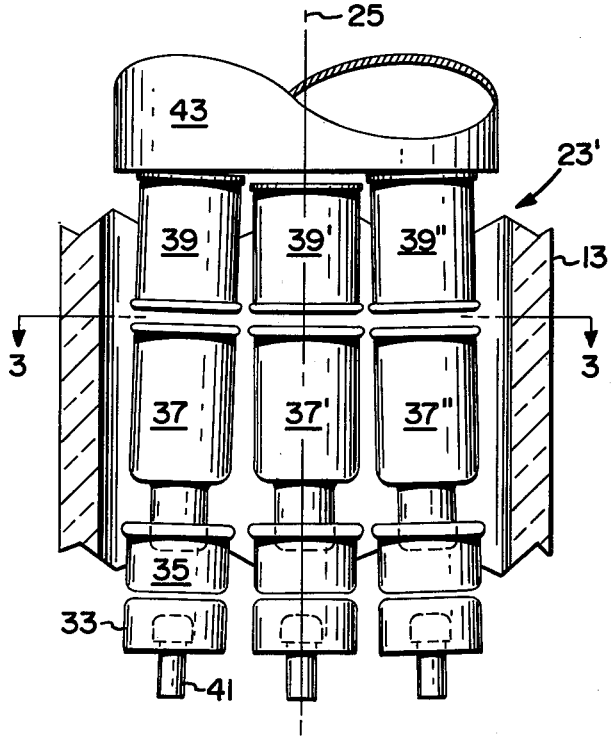
Fig. 2
PRIOR ART
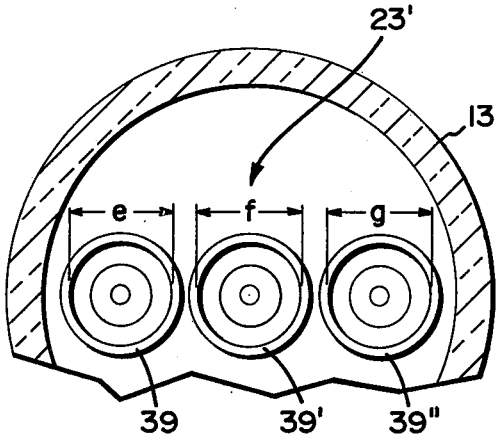
Fig. 3
PRIOR ART

PLURAL BEAM ELECTRON GUN ASSEMBLY

CROSS REFERENCE TO RELATED APPLICATIONS

This application contains matter disclosed but not claimed in two related United States patent applications filed concurrently herewith and assigned to the assignee of the present invention. These related applications are: Ser. No. 699,440, and Ser. No. 699,424.

BACKGROUND OF THE INVENTION

This invention relates to a plural beam cathode ray tube and more particularly to a three-beam in-line bi-potential electron gun assembly as utilized in a color cathode ray tube.

Many of the cathode ray tubes presently utilized in color television display applications are of the type employing a patterned multi-phosphor cathodoluminescent screen interiorly disposed upon the viewing panel of the tube envelope wherein an apertured or multi-opening mask is spatially positioned in relation thereto. A plurality of electron beams, emanating from an electron gun assembly positioned within the neck portion of the tube envelope, are directed to converge at and traverse the apertured mask to thence selectively impinge and luminescently excite the electron responsive phosphors comprising the patterned screen therebeyond. Focusing of the individual electron beams is conventionally achieved by means of discrete electron lensing, such as bi-potential focus lensing; such being dependent upon the ratio of the focus voltage to the respective accelerating electrode or anode voltage.

The aforementioned cathodoluminescent screen is of the type made up of repetitive patterns formed, for example, of individual dots or stripes of red, green and blue-emitting phosphor components. Since these phosphor materials exhibit differences in efficiency, they require excitation by electron beams of different current levels to produce substantially equal light output. Additional differences in excitation current arise because of the non-uniform response of the human eye to various colors. Thus, to produce white light, more beam current is required to excite the green-emitting phosphor than is necessary to excite the respective red and blue associated color-emitting materials. Each of the exciting beams emanates from a separate electron gun structure which collectively constitute the gun assembly. In a conventional assembly the several cooperating electrode components of each gun are substantially dimensionally similar to the respective components of the related gun structures comprising the assembly.

The differences of operating intensities of the several electron beam producing guns functioning simultaneously within the tube to provide a desired white, are conventionally expressed in terms of at least two gun current ratios; namely, red to green (R/G) and red to blue (R/B). For example, in a tube having the red, green and blue electron guns operating in concert to provide a desired cathodoluminescent white, a red/green gun ratio of 1.4:1 indicates that an electron beam current of 40 percent greater intensity is required for the red gun than is needed for the green gun to provide the necessary individual brightness levels of the respective red and green emitting phosphors. Correspondingly, in the same tube, a red/blue gun ratio of 1.6:1 denotes that the red gun must deliver 60 percent more beam current than the blue gun to satisfactorily synthesize the white field in the simultaneously excited screen. In accordance with the electron-optics properties of electron guns evidencing substantially equal focusing lenses, the respective diameters of the several electron beams tend to "bloom" or become larger as the applied beam currents are increased. Thus, the apparent sharpness of the imagery evidenced in the screen of a color cathode ray tube is resolved in accordance with the respective beam diameters impinging the associated phosphor components of the patterned screen. Accordingly, reduced brightness and diminished resolution of imagery is evidenced with beam landings of larger spot size.

OBJECTS AND SUMMARY OF THE INVENTION

It is an object of the invention to reduce and obviate the aforementioned disadvantages evidenced in the prior art, Another object of the invention is to effect structural changes within the electron gum assembly to provide improved resolution of color cathode ray tube imagery with an associated increase of brightness. A further object of the invention is to effect structural gun changes in the assembly to improve resolution of the cathode ray tube imagery without requiring an increase in the neck diameter of the encompassing envelope.

These and other objects and advantages are achieved in one aspect of the invention wherein there is provided a modification in the structure of the cathode ray tube plural beam inline electron gun assembly wherein at least one of the gun structures, having a beam current level differing from heat applied to the other guns therein, is modified to effect a change in the diameter and length of the focusing lensing effecting the electron beam traversing therethrough. This structural modification is accomplished by changing the length of the focusing electrode member in conjunction with the change of diameter of the output portion of the focusing electrode. The diametrically modified output portion of the focusing member is ingressively positioned, in a limited manner, within the compatibly dimensioned related acceleration electrode to provide a partial telescoping arrangement for effecting the forming and shielding of a large focusing lens substantially encompassed within the accelerator electrode. This modification of the final lensing provides focusing of the respective beam to a spot size at the screen which is of a dimension substantially equalling the spot sizes of the associated beams having differing beam currents and emanating from the related guns of the assembly. Thus, by these structural modifications there is provided a marked improvement in the total effective resolution and brightness of the display imagery evidenced in the screen of the tube.

BRIEF DESCRIPTION OF THE DRAWINGS

FIG. 1 is an illustration of a color cathode ray tube partially sectioned to show the environment wherein the improvement of the invention is oriented;

FIG. 2 is a prior art elevational view of an in-line three-beam cathode ray tube electron gun assembly;

FIG. 3 is a prior art plan view of a gun assembly illustrated in FIG. 2, taken along the line 3—3 thereof, showing equal diameters of the related gun structures;

DESCRIPTION OF THE PREFERRED EMBODIMENTS

Figure 4:
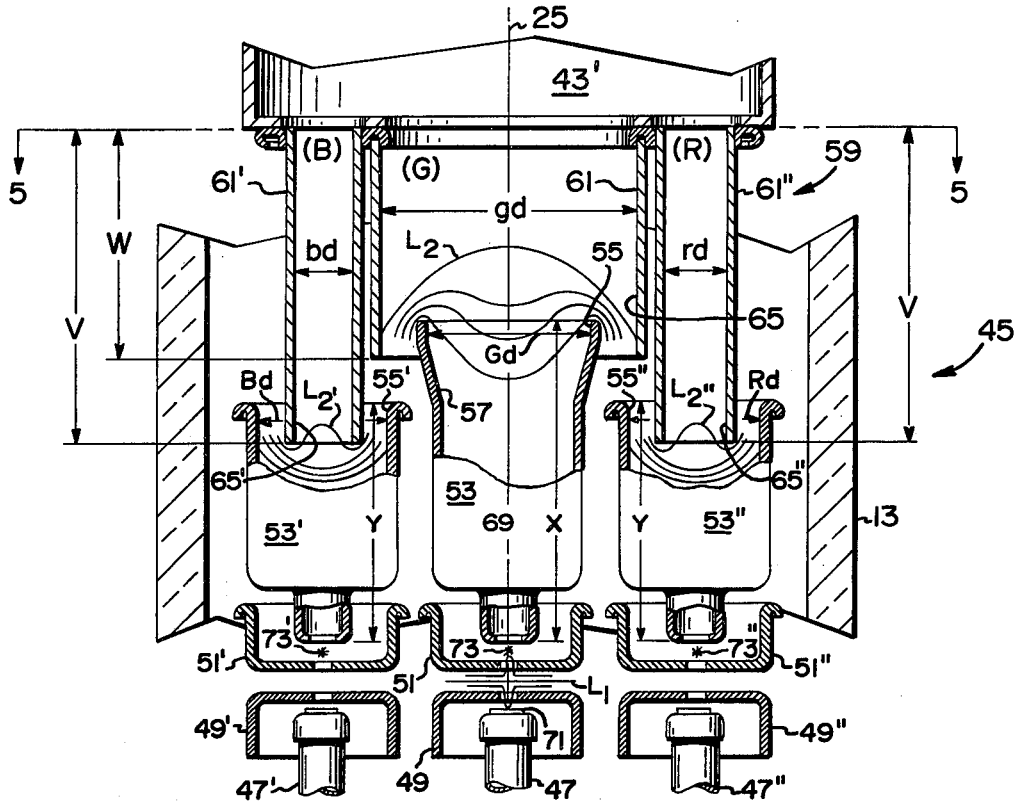
FIG. 4 is a sectional view illustrating the improved gun structure of the invention.

For a better understanding of the present invention, together with other and further objects, advantages and capabilities thereof, reference is made to the following specification and appended claims in connection with the aforedescribed drawings.

With reference to the drawings, it is shown in FIG. 1 a partially sectioned multi-beam color cathode ray tube 11 having an encompassing envelope comprised of an integration of a nect portion 13, a funnel portion 15, and a face or viewing panel portion 17. A patterned cathodoluminescent screen 19 including a repetitive plurality of color-emitting phosphor components is discretely disposed on the interior surface of the viewing panel 17. A multi-opening mask member 21 is positioned within the viewing panel, by means not shown, in a manner whereof the multi-opening portion is spatially related to the patterned screen 19. Positionally encompassed within the neck portion 13 of the envelope is a multi-beam in-line electron gun assembly 23 comprised of three bi-potential guns 26, 28 and 30 having a longitudinal axis 25 therethrough. The individual guns of this assembly form and direct three separate electron beams 27, 29 and 31 to discretely impinge the patterned screen 19. It is within this electron gun assembly that the improvement of the invention resides.

To fully understand the marked significance of the invention, attention is directed to FIGS. 2 and 3 wherein a prior art three beam in-line bi-potential gun structure assembly 23' is shown. In a multi-beam construction of this type, each of the respective beams 27, 29 and 31 traverses a substantially longitudinal arrangement of several functionally related electrode members including, as for example, a control electrode 33, an initial accelerator 35, a focusing electrode 37, and a final accelerator 39 all of which are positioned in a sequential manner forward of a rear-oriented cathode member 41. Additionally, it has been conventional practice, to terminally position on the forward portions of the final accelerators 39, 39' and 39'', an apertured common cup-like member 43 wherein shunts and/or enhancers may be located in accordance with the known state of the art. As shown, this arrangement constitutes an in-line bi-potential electron gun assembly for effecting the formation and control of each of the respective electron beams 27, 29 and 31. The aforementioned plurality of electrode members comprising each of the individual guns within the assembly 23', are conventionally positioned and held in spaced relationship with respect to one another by a plurality of longitudinal insulative support rods, which, for purposes of clarity, are not shown. It is clearly evident that the diameters *e*, *f* and *g* of the final focusing 37, 37', 37'' and final acceleration electrode members 39, 39', 39'' are substantially equal for the respective guns. Therefore, final focusing lensing which is formed interspatially between the focusing and final acceleration electrodes is substantially equal for each of the three guns. Since each of the guns forms and directs its individual electron beam in accordance with the respective beam current applied thereto, the focus spot size of beam impingement at the screen will vary in accordance with the beam current applied to the particular gun. Thus, as a result of the differing beam currents and resultant differing beam landing spot sizes, the resolution and brightness of the screen imagery is noticeably impaired.

Figure 5:
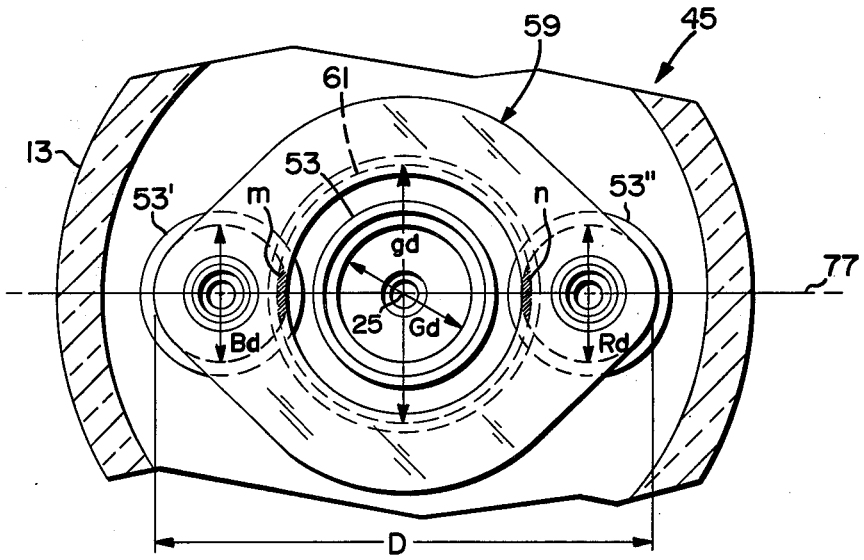
FIG. 5 is a plan view of a portion of the improved assembly as portrayed in FIG. 4 taken along the line 5—5 thereof, wherein varied gun diameters are shown.

The invention relates to a structural modification of the plural beam in-line electron gun assembly as exemplarily illustrated in FIGS. 4 and 5. There is shown therein a modified gun assembly construction 45 embodying a plurality of bi-potential structures wherein the center or exemplary green gun (G) evidences a final focusing electrode diameter "Gd" which is larger than the diameters "Bd" and "Rd" of the respective exemplary blue (B) and red (R) side-related guns of the assembly 45. It is to be noted that the resultant final focusing lensing ($L_2$) of the center gun (G), which is substantially encompassed within the final acceleration electrode, is of an increased diameter and length. The lens ($L_2$) so formed exhibits reduced spherical aberration and efficiently focuses the beam to a landing spot size at the screen which is of a size substantially equalling the spot sizes effected by the respective lensings ($L_2'$) and ($L_2''$) of the related side-oriented guns (B) and (R) which are effected substantially within the confines of the respective focusing electrode members. To achieve the increased object focal length of the larger diametered center gun lensing ($L_2$), a longer focusing electrode structure is required.

In greater detail, further reference is directed to FIGS. 4 and 5. The cathode means 47', 47, 47'', the associated apertured control electrode means 49', 49, 49'' and the related apertured initial accelerator means 51', 51, 51'' for the three gun structures (B), (G), (R) are positioned in their respective common planes. The focusing electrode members 53', 53, 53'' for the three guns have front and rear apertures formed therein whereof the respective electrode lengths are defined therebetween. The rear apertures thereof being in a common plane adjacent the related apertures of the initial accelerator electrodes 51', 51, 51''. The modified center focusing electrode 53, also referenced as alpha, has a front aperture 55 defined by a protruding terminal tubular member 57 which effects a diameter (Gd) that is larger than the diameter (Bd) and (Rd) of the front apertures 55' and 55'' of the adjacently related focusing electrode members 53' and 53''. These smaller-apertured side-related focusing electrodes are also referenced as beta. In addition to its larger front aperture 55, the alpha focusing member 53 has a greater definitive length (X) than that (Y) of the side-related beta focusing members 53' and 53'' to provide an increased object focal length for the larger lensing ($L_2$) effected by the alpha focusing electrode. As such, the front alpha aperture 55 is in a plane forward of the respective plane of the related front beta aperture 55' and 55''.

The final accelerator means is, for example, a unitized structure 59 formed of three in-line cylindrical electrode members 61', 61 and 61'' each having front and rear apertures with definitive electrode lengths therebetween. The three front apertures are in a common plane whereupon a cup-like terminal member 43' is affixed. The cylindrical acceleration electrode members are formed as substantially tube-like structures exhibiting differing diameters (*bd*), (*gd*), (*rd*) and definitive lengths (V), (W), (V), and in this instance, the center electrode or larger diametered electrode 61 is referenced as delta and the smaller side-related electrodes 61' and 61'' as theta. The differing delta and theta electrode lengths, (W) and (V) respectively, affect the positioning of the respective rear delta 65 and theta 65', 65'' apertures in two spatially related parallel planes relative to the respective planes of the front alpha 55 and beta 55', 55'' apertures of the alpha 53' and beta 53', 53'' focusing electrodes. The delta accelerator member 61 is shortest in length (W) and evidences an apertural dimension (*gd*) that is larger than the front aperture 55 of the related alpha protruding focusing electrode member 53. Such dimensional relationships enable the terminal portion 57 of the alpha protruding focusing member 53 to be spatially and ingressively positioned in a limited manner slightly within the apertural opening 65 of the larger delta accelerator member 61. This discrete orientation provides a partial telescoping arrangement for effecting the forming and shielding of the large focusing lens ($L_2$) which is substantially encompassed within the delta accelerator electrode 61. This modified lensing provides efficient focusing of the electron beam of highest current level, which in this instance is that exemplarily denoted as the green phosphor-exciting beam emanating from the (G) gun.

The side-positioned theta accelerator electrodes 61' and 61'' are longer cylindrical constructions and evidence rear aperture diameters (*bd*) and (*rd*) that are smaller than the related front apertures 55' and 55'' of the related beta focusing electrodes 53' and 53''. This dimensional relationship permits the rear portions of the respective theta accelerator members 61' and 61'' to be ingressively oriented in a limited manner slightly within the front apertures 55' and 55'' of the respective beta focusing electrodes to provide a partial telescoping arrangement for effecting the formation and shielding of smaller focusing lensings ($L_2'$) and ($L_2''$) which are substantially encompassed within the forward portions of the beta focusing electrodes. Such lensings provide focusing of the electron beams of lower current levels, such as for example, the blue and red phosphor excitant beams. The reversal in the telescoping direction of the focusing and accelerator electrodes for the center and side related guns permits an optimizing of the diameters of the respective focus lensings for a given neck size. The telescoping arrangement minimizes external disturbance of the lens action; thus, the outer beams may be located in close proximity to the neck glass and to the center lens without causing beam convergence drift.

Referring particularly to the center gun (G), the exemplary substantially axially oriented electron beam 69 emanating from the terminally disposed emissive material 71 of the cathode 47, in passing through the initial focusing lens ($L_1$) interspatially located between the control 49 and the initial acceleration electrodes 51, is directionally influenced to produce a cross-over image, as at 73, which is effected slightly within the initial accelerating electrode 51. This image or beam size is directly related to the amount of beam current applied to the particular gun, which in this instance is the highest current supplied to the assembly. It is this spot size that is magnified and ultimately imaged on the screen by the final focusing lensing ($L_2$). In similar manner, each of the side-related guns (B) and (R) has a respective beam cross-over or image point at approximately similar locations 73' and 73'' within its respective initial acceleration electrode. These images are likewise magnified and focused through their respective final focusing lensings ($L_2'$) and ($L_2''$) to impinge upon the screen in the manner desired.

In accordance with the invention, the diametrical dimensionings of the final focusing lensings ($L_2'$), ($L_2$), ($L_2''$) affecting the respective electron beams are determined by the available transverse spatial area in the gun assembly, such being directly related in a spaced manner to the wall of the encompassing neck portion 13. The transverse space in the assembly is then allotted to the individual guns on the basis of the differing beam currents supplied to the respective guns. While it is possible to design each gun to have a final focusing lens of an optimized diameter in keeping with the particular beam current applied thereto, it is most expeditious from a constructional consideration, to provide each of the side-related guns with compromised lensing. For example, a tube having a modified gun structure in accordance with the invention, such as is shown in FIG. 4, may have a screen that is suitably responsive to the following exemplary beam currents:

| | | | | |
|---|---|---|---|---|
| (R) | red gun | = | 181 | ua or 23% of total current |
| (G) | green gun | = | 346 | ua or 43% of total current |
| (B) | blue gun | = | 273 | ua or 34% of total current |
| | | | 800 | ua total for 9300° K white. |

Averaging the red and blue beam currents effects a compromised percentage in the order of 28.5 percent. The aforedescribed gun structure 45, being spatially encompassed within the confines of the neck of the envelope 13, presents the usable or allotted transverse dimension (D) wherein the three final lensings ($L_2'$) ($L_2$) and ($L_2''$) must be contained. The gun construction of the invention advantageously allows the diametrically allotted space within the neck portion 13 to be used in a much more efficient manner, since the differentially formed focusing lenses ($L_2$), ($L_2'$) and ($L_2''$) are oriented in substantially different parallel planes normal to the axis 25. Such positioning of the lenses permits a partial overlapping thereof in the common axial plane of the beams 77, without disturbing the axial symmetry in the lensing region, such being clearly illustrated in FIGS. 4 and 5. The partial overlapping of the respective lensings is exemplarily denoted as (m) and (n). Therefore, diametrical spacing within the gun structure, wherein the three lensings are defined, is denoted as:

$$Bd + gd + Rd + m + n = D'.$$

Thus, the respective lens diameters of the exemplarily designated blue (B) and red (R) guns, as based upon beam current percentages, are in the order of:

28.5 percent of $D' = Bd$ and $Rd$ respectively.

Similarly, the final lensing of the center or green gun is in the order of:

43.0 percent of $D' = gd$.

The aforenoted respective telescoping relationships of the diametrically related focusing and accelerator electrodes provides final focus lensings which are primarily confined within and partially shielded by the associated electrode arrangements. The shielding effect allows the side gun structures to be positioned closer to the side wall of the neck portion than normally permitted. The actual displacement of the respective lensings and the self-shielding aspects thereof beneficially minimizes the inter-acting influences therebetween. Thus, the respective lensings formed by the construction of the invention evidence reduced spherical aberration for the beams of differing current levels applied to the respective guns. The differentially dimensioned lenses focus the respective beams to substantially equal spot sizes at the screen thereby providing improved resolution and brightness of the screen imagery.

Figure 6:
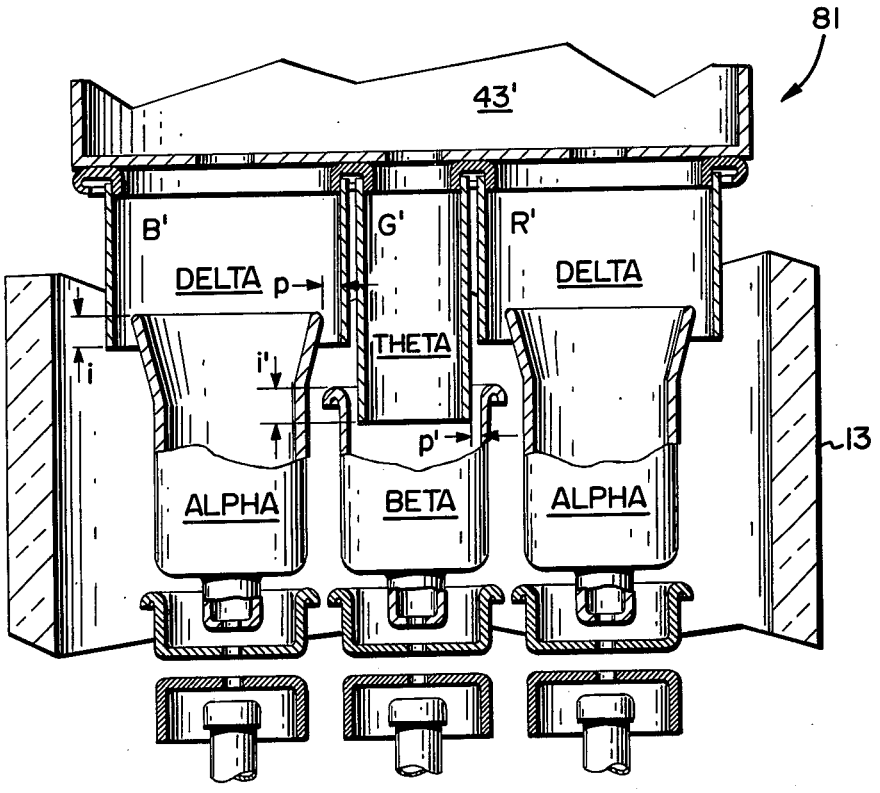
FIG. 6 is a sectional view of another embodiment of the invention.

While in the first described embodiment of the invention the center gun has been described as utilizing the larger alpha focusing electrode and delta accelerator electrode relationship to efficiently handle the largest of the beam currents applied to the gun assembly, there may be beam current relationships wherein the smallest of the beam currents would be desirably applied to the center gun of the assembly construction. A second constructional embodiment 81, as shown in FIG. 6, is of that type and such is included within the concept of the invention. In the second structurally-modified embodiment, the center gun (G′) utilizes the smaller beta focusing electrode and theta accelerator electrode relationship. In this construction, the larger focusing lenses of the side-related guns (B′) and (R′) partially overlap the lensing of the center gun in a manner substantially reverse to that shown in FIG. 5. Telescoping electrode arrangements are likewise beneficially applied in this construction.

In each of the constructions of the embodiments shown, the length of the delta accelerator cylinder is at least equal to the diameter of the front aperture of the alpha focusing electrode. The respective lengths of the theta accelerator cylindrical electrode members are determined by the positionings of the beta focusing electrodes.

In each embodiment, the amount of ingression $i$, $i'$ of the respective accelerator and focusing electrode arrangements is preferably at least equal to the peripheral or gap spacing $p$, $p'$ evidenced between the respective telescoped electrodes.

Thus, the constructional modifications of the invention provides improved resolution of color cathode ray tube imagery with an associated increase in brightness. In keeping with the invention, one or more of the electron guns in the in-line bi-potential gun assembly are modified to effect final focusing lensings that are partially shielded and partially overlapping, being effected in differential planes within the gun assembly. The dimensionings of the telescoping, focusing and accelerator electrode arrangements are directly relatable to the differnt levels of beam current assigned to the respective guns. Thus, final focusing lenses of substantially unequal diameters may be provided for the respective beams to effect beam landings of substantially equalized spot sizes at the screen.

While there has been shown and described what are at present considered the preferred embodiments of the invention, it will be obvious to those skilled in the art that various changes and modifications may be made therein without departing from the scope of the invention as defined by the appended claims.

What is claimed is:

1. A modified cathode ray tube three beam in-line bi-potential electron gun assembly having a longitudinal axis therethrough and including electron generating means formed to emit said respective beams of substantially differing current levels in a substantially common plane coextensive with said axis, said beams being directed from a center and two side-related guns to selectively impinge a spatially related patterned electron responsive screen, said electron gun assembly comprising in sequential order:

cathode means oriented in a common plane;

apertured control electrode means associated with said cathode means oriented in a common plane spatially related thereto;

apertured initial accelerator means positioned adjacent said control electrode means with the apertures thereof being in a common plane proximal to the apertures of said control electrode means;

focusing electrode means each having front and rear apertures with defined electrode lengths therebetween, said rear apertures being in common plane adjacent related apertures of said initial accelerator means, at least one of said focusing electrodes being an alpha member having a front aperture defined by a protruding tubular member having a diameter larger than that of the front apertures of the adjacently related beta focusing electrode members and having a definitive length greater than that of said beta members to provide an increased object focal length for said alpha focusing electrode, said front alpha aperture being in a plane forward of the respective plane of said related front beta apertures; and final accelerator means in the form of three in-line cylindrical electrode members each having front and rear apertures with definitive electrode lengths therebetween, said front apertures being in a common plane whereupon a cup-like terminal member is affixed, said cylindrical electrode members being substantially tube-like structures exhibiting at least differing delta and theta diameters and at least differing delta and theta definitive lengths thereby effecting the positioning of the respective rear delta and theta apertures in two parallel planes relative to the respective planes of the front apertures of said alpha and beta focusing electrodes, said delta accelerator member being the shortest in length and evidencing the largest apertural dimension such being larger than that of the related alpha protruding focusing electrode, the terminal portion of said alpha protruding focusing member being spatially and ingressively positioned slightly within the apertural opening of the larger delta accelerator member to provide a partial telescoping arrangement for effecting the forming and shielding of a large focusing lens substantially encompassed within said delta accelerator electrode thereby providing efficient focusing of the beam of highest current level, said side-positioned theta accelerator electrodes being longer cylindrical constructions evidencing rear apertured diameters smaller than said related front apertures of said related beta focusing electrodes wherein said respective theta accelerator members are ingressively oriented to provide a partial telescoping arrangement for effecting the forming and shielding of smaller focusing electrodes thereby providing focusing of the beams of lower current levels.

2. The modified cathode ray tube plural beam in-line bi-potential electron gun assembly according to claim 1 wherein said center gun is oriented substantially on said longitudinal axis, and wherein said center gun utilizes the larger alpha focusing electrode and delta accelerator electrode relationship, and wherein said center gun is the one to which the highest of said beam currents is applied.

3. The modified cathode ray tube plural beam in-line bi-potential electron gun assembly according to claim 1 wherein said center gun is oriented substantially on said longitudinal axis, and wherein said center gun utilizes the smaller beta focusng electrode and theta accelerator electrode relationship, and wherein said center gun is the one to which the lowest of said beam currents is applied.

4. The modified cathode ray tube plural beam in-line bi-potential electron gun assembly according to claim 1 wherein said differentially formed focusing lenses are oriented in substantially different parallel planes normal to said axis, and wherein said lenses are partially overlapping in the common plane of said beams.

5. The modified cathode ray tube plural beam in-line bi-potential electron gun assembly according to claim 1 wherein the length of said delta accelerator cylinder is at least equal to the diameter of said front aperture of said alpha focusing electrode.

6. The modified cathode ray tube plural beam in-line bi-potential electron gun assembly according to claim 1 wherein the amount of ingression of the respective accelerator and focusing electrode arrangements is preferably at least equal to the peripheral spacing between the respective electrodes.

7. An improved color cathode ray tube utilizing a plurality of electron beams and having an envelopic enclosure formed of an integration of panel, funnel and neck portions, said tube comprising:

a cathodoluminescent screen formed of three color-emitting phosphor components disposed upon the interior surface of said panel in a repetitive pattern arrangement;

a multi-opening mask member positioned within said panel in spaced relationship to the patterned screen disposed thereon; and a three-beam in-line bi-potential electron gun assembly having a longitudinal axis therethrough oriented within said neck portion in a manner to direct said beams to traverse said mask and impinge the phosphor components of said screen, said assembly having an axis therethrough with a center gun positioned substantially thereon and flanked on either side by a related gun structure, each of said guns having the capability for handling a different level of beam current when applied thereto, said beams emanating from a three gun assembly formed of electrode members positioned in a spaced sequential order forward of rear-oriented cathode means oriented in a common plane; apertured control electrode means associated with said cathode means oriented in a common plane spatially related thereto; apertured initial accelerator means positioned adjacent said control electrode means with the apertures thereof being in a common plane proximal to the apertures of said control electrode means; focusing electrode means each having front and rear apertures with defined electrode lengths therebetween, said rear apertures being in a common plane adjacent related apertures of said initial accelerator means, at least one of said focusing electrodes being an alpha member having a front aperture defined by a protruding tubular member having a diameter larger than that of the front apertures of the adjacently related beta focusing electrode members and having a definitive length greater than that of said beta members to provide an increased object focal length for said alpha focusing electrode, said front alpha aperture being in a plane forward of respective plane of said related front beta apertures; and final accelerator means in the form of three in-line cylindrical electrode members each having front and rear apertures with definitive electrode lengths therebetween, said front apertures being in a common plane, said cylindrical electrode members being substantially tube-like structures exhibiting at least different delta and theta diameters and at least differing delta and theta definitive lengths thereby effecting the positioning of the respective rear delta and theta apertures in two parallel planes relative to the respective planes of the front apertures of said alpha and beta focusing electrodes, said delta accelerator member being the shortest in length and evidencing the largest apertural dimension such being larger than that of the related alpha protruding focusing electrode, the terminal portion of said alpha protruding focusing member being spatially and ingressively positioned slightly within the apertural opening of the larger delta accelerator member to provide a partial telescoping arrangement for effecting the forming and shielding of a large focusing lens substantially encompassed within said delta accelerator electrode thereby providing efficient focusing of the beam of highest current level, said side-positioned theta accelerator electrides being longer cylindrical constructions evidencing rear apertured diameters smaller than said related beta front apertures of said related beta focusing electrodes wherein said respective theta accelerator members are ingressively oriented to provide a partial telescoping arrangement for effecting the forming and shielding of smaller focusing lensings substantially encompassed within said beta focusing electrodes thereby providing focusing of the beams of lower current levels.

8. The improved color cathode ray tube according to claim 7 wherein the modified cathode ray tube plural beam in-line bi-potential electron gun assembly has said center gun oriented substantially on said longitudinal axis, and wherein said center gun utilizes the larger alpha focusing electrode and delta accelerator electrode relationship, and wherein said center gun is the one to which the highest of said beam currents is applied.

9. The improved color cathode ray tube according to claim 7 wherein the modified cathode ray tube plural beam in-line bi-potential electron gun assembly has said center gun oriented substantially on said longitudinal axis, and wherein said center gun utilizes the smaller beta focusing electrode and theta accelerator electrode relationship, and wherein said center gun is the one to which the lowest of said beam currents is applied.

* * * * *

UNITED STATES PATENT AND TRADEMARK OFFICE

CERTIFICATE OF CORRECTION

PATENT NO. : 4,028,581

DATED : June 7, 1977

INVENTOR(S) : Michael G. Stratton

It is certified that error appears in the above-identified patent and that said Letters Patent are hereby corrected as shown below:

Col. 2, line 34 - After "from", please delete "heat" and insert -- that --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*